US006082148A

United States Patent [19]

Wakai et al.

[11] Patent Number: 6,082,148

[45] Date of Patent: Jul. 4, 2000

[54] WARP-KNIT TAPE FOR SLIDE FASTENER

[75] Inventors: Tatsumi Wakai; Sadaji Okeya, both of Toyama-ken, Japan

[73] Assignee: YKK Corporation, Tokyo, Japan

[21] Appl. No.: 09/266,169

[22] Filed: Mar. 10, 1999

[30] Foreign Application Priority Data

Mar. 20, 1998 [JP] Japan ..... 10-072630

[51] Int. Cl.[7] ..... D04B 21/00

[52] U.S. Cl. ..... 66/192; 66/195

[58] Field of Search ..... 66/169 R, 170, 66/190, 192, 193, 195; 24/393, 391, 392, 397, 398

[56] References Cited

U.S. PATENT DOCUMENTS

| | | | |
|---|---|---|---|
| 3,552,154 | 1/1971 | Lesley | 66/192 |
| 4,419,868 | 12/1983 | Matsuda | 66/195 |
| 4,450,694 | 5/1984 | Matsuda et al. | 66/195 |
| 4,918,793 | 4/1990 | Spindler | 66/195 |
| 5,540,064 | 7/1996 | Matsuda et al. | 66/192 |
| 5,706,677 | 1/1998 | Matsuda | 66/192 |
| 5,857,359 | 1/1999 | Matsuda et al. | 66/192 |

FOREIGN PATENT DOCUMENTS

| | | |
|---|---|---|
| 49-88645 | 12/1972 | Japan . |
| 63-294804 | 12/1988 | Japan . |

*Primary Examiner*—Larry Worrell, Jr.
*Attorney, Agent, or Firm*—Hill & Simpson

[57] ABSTRACT

The present invention provides a warp-knit tape for a slide fastener which can well follow stretch and contraction of highly elastic cloth and is suitable for use in a state where the tape is sewn onto the highly elastic cloth, as a chain split and a puckering phenomenon are not generated. The warp-knit tape includes a coupling element mounting portion which is inelastic in a warp direction and a tape main body portion which is highly elastic in the warp direction. A buffer area including only weft in-laid yarns, for example, for intercepting influence of acts of the coupling element mounting portion and the main body portion on each other is defined between the mounting portion and the main body portion.

9 Claims, 11 Drawing Sheets

WARP-KNIT TAPE FOR SLIDE FASTENER

BACKGROUND OF THE INVENTION

1. Field of the Invention

The present invention relates to a warp-knit tape for a slide fastener, which is formed of a warp knitting structure, wherein a longitudinal stretch and contraction of a coupling element mounting portion are suppressed and tape main body portion has a property to longitudinally stretch and contract, and particularly relates to a warp knitting tape for a slide fastener having a structure wherein the coupling element mounting portion and a tape main body portion act independently of each other.

2. Description of the Related Art

Recently, a slide fastener is frequently used for clothes in fashion and underwear. Conventionally, the slide fastener is frequently used for elastic clothes such as clothes made of knitted cloth or highly elastic sportswear. In order to make the slide fastener applicable to the above various elastic clothes, a weaving structure, a knitting structure, or material of constituent yarns of the slide fastener tape is selected in weaving or knitting the tape, the coupling element mounting portion on a longitudinal edge of the tape is made inelastic, and the remaining tape main body is provided with elasticity in a longitudinal direction.

There is a conventional slide fastener tape as disclosed in Japanese Patent Laid-open Publication No. 49-88645, for example, wherein inelastic warp yarn is used for forming the coupling element mounting portion so as to suppress longitudinal elasticity of the coupling element mounting portion, while elastic yarn is used as the warp for forming the tape main body portion so as to provide longitudinal elasticity to the tape main body portion. The coupling element mounting portion is inelastic in order to prevent a chain split, i.e., prevent the coupled elements mounted to the coupling element mounting portion from being detached from each other and to prevent the fastener from opening due to pulling forces applied from all directions to the clothes which stretch and contract in response to movements of a body, when the elements of the slide fastener are coupled.

If the coupling element mounting portion is made completely inelastic as described above, a strained phenomenon is generated in a slide fastener mounting portion and a significant disharmony in appearance is generated in the clothes, at the time of an intense exercise such as bending and stretching of the body. In order to eliminate this defect, there is a slide fastener as disclosed in Japanese Patent Laid-open Publication No. 63-294804, wherein a stretch degree of at least an edge side of the coupling element mounting portion of the fastener tape including the edge side of the coupling element mounting portion in a longitudinal direction is set at 10% or more. The stretch degree is controlled in such a range that a pitch of the coupling elements at the time of stretch is less than a double of a height of the coupling head, and the pitch of the coupling elements is varied in accordance with stretch and contraction of the edge side of the coupling element mounting portion. Moreover, because the pitch variation is within a range of a value smaller than the double of the height of the coupling head, the coupling elements are not detached from each other even if the coupling element mounting portion stretches.

However, in the above fastener tape disclosed in Japanese Patent Laid-open Publication No. 63-294804, if the tape main body has such an elasticity that the tape main body stretches and contracts following the stretch and contraction of the highly elastic clothes, for example, a difference between the stretch degrees of the tape main body and the coupling element mounting portion is increased. As a result, it is impossible to eliminate disharmony of clothes in appearance, which has been a conventional desire.

SUMMARY OF THE INVENTION

It is an object of the present invention to provide a fastener tape which is particularly suitable for a tape for a slide fastener sewn on a highly elastic cloth, can well follow stretch and contraction of the highly elastic cloth, and a chain split is not generated, and to provide a fastener tape, wherein a puckering phenomenon is not generated between a cloth and a slide fastener along a sewing line.

In development of the fastener tape wherein the puckering phenomenon is not generated between the sewn cloth and slide fastener, the tape can sufficiently follow various movements of the highly elastic cloth, and the chain split is not generated, the present inventors have noticed that a knitting tape formed of a warp knitting structure is the most preferable as a structure having a high elasticity and an excellent stability of a shape of a fastener tape, after various examinations and experimental production. Therefore, the fastener tape of the present invention employs the warp knitting structure.

The warp-knit tape naturally has less elasticity in a width direction, but has excellent elasticity in a warp knitting direction, i.e., a longitudinal direction of the tape. In order to provide higher elasticity to the tape in the longitudinal direction, it is considered to be important to use an elastic yarn at least as a yarn for forming a tape area which is required to be elastic. However, if the tape area is formed of only the elastic yarns, a shape of the tape is unstable, and the tape is not suitable for normal elastic clothes because of excessively high elasticity. Therefore, as a knitting structure of the tape area which is required to be elastic, a mixed knitting structure of an inelastic yarn and an elastic yarn is employed.

In the present invention, because it is impossible to prevent generation of the chain split of the coupling elements with normal shapes if the coupling element mounting portion has the same elasticity as the highly elastic tape area, the coupling element mounting portion has an inelastic structure similarly to conventional art. The inelastic structure according to the present invention includes the elasticity allowed for the coupling element mounting portion disclosed in the above Japanese Patent laid-open Publication No. 63-294804.

As described above, by only suppressing the elasticity of the coupling element mounting portion similarly to conventional art, the above-described conventional problems are not solved naturally. The inventors have accomplished the present invention through repeated trials and errors, and the above object of the invention is achieved by the following structures as described below.

According to an aspect of the invention, there is provided a warp-knit tape for a slide fastener comprising a coupling element mounting portion and a tape main body portion, wherein the coupling element mounting portion has an inelastic knitting structure in a longitudinal direction, the tape main body portion has an elastic knitting structure in a longitudinal direction, and a buffer area for intercepting influences of acts of the coupling element mounting portion and the tape main body portion on each other is defined between the mounting portion and the tape main body portion.

As main means for providing elasticity to the warp knitting structure, there are properties of the knitting structure and constituent yarns. In general, a chain stitch structure has the lowest longitudinal elasticity due to the knitting structure, the tricot knitting structure has higher elasticity, and the single cord knitting structure has further higher elasticity. Elasticity of the warp knitting structure due to the forming yarn streak is the highest in a knitting formed of an elastic yarn such as a spuntex yarn and a rubber yarn or a covered yarn of the spuntex yarn and the rubber yarn, naturally.

In the present invention, by defining the buffer area between the inelastic coupling element mounting portion and the highly elastic tape main body portion having the above knitting structures, it is possible to prevent intense stretch and contraction of the highly elastic tape main body portion from affecting the inelastic coupling element mounting portion and to allow the tape main body portion and the coupling element mounting portion to act independently of each other. In other words, according to the invention, in spite of various stretching and contracting movements of the tape main body portion, the chain split is not generated, a strained phenomenon peculiar to the coupling element mounting portion is not generated, and there is no disharmony in terms of appearance and a touch in the tape.

Moreover, the most effective point of the invention is that puckering is not generated when the slide fastener employing the warp-knit tape of the invention is sewn onto highly elastic cloth, because it is possible to provide high elasticity to the tape main body portion. When highly elastic cloth and inelastic cloth are sewn together, the elastic cloth stretches when carried for sewing, but the inelastic cloth does not stretch following the stretch of the elastic cloth. Therefore, sewing proceeds while displacement of the elastic cloth and the inelastic cloth from each other is generated, resulting in a sewn product in a waved state along the sewing line. This phenomenon is especially remarkable when the cloth is flexible and thin. According to the invention, because the tape main body portion which is within an area of the fastener tape to be sewn is provided with high elasticity similarly to the highly elastic cloth on which the tape is to be sewn, the tape and the cloth move together smoothly in the sewing, and thus, the sewn product with a desirable quality wherein the puckering is not generated can be obtained.

Preferably, the knitting structure of the coupling element mounting portion includes a plurality of knitting structures using an inelastic yarn, the tape main body portion includes at least a mixed structure of an inelastic yarn and an elastic yarn, and the buffer area includes at least a part of the knitting structure of the inelastic yarn of the tape main body portion in common with the tape main body portion.

Only the inelastic yarn is used for the coupling element mounting portion, and the knitting structure of the coupling element mounting portion is formed by combining a plurality of structures for suppressing normal elasticity such as a chain stitch structure, a tricot knitting structure, and a warp in-laid structure, for example, and by laying a weft yarn in each of the above structures. In the knitting structure of the elastic tape main body portion, on the other hand, elasticity is provided to both the knitting structure and the constituent yarns, and the knitting structure is employed wherein the elastic yarn is used as a part of the constituent yarns, the elastic yarn is interlace with the inelastic yarn, the shape of the knitting is the most stable as the knitting structure, and necessary elasticity can be obtained. By forming the buffer area by using the knitting structure of only the inelastic weft in-laid yarn extending from the tape main body portion, it is possible to completely intercept the influence of the act of the tape main body portion on the coupling element mounting portion by the buffer area.

And preferably, the knitting structure of the inelastic yarn of the tape main body portion includes at least a weft in-laid structure and a chain stitch structure, and the knitting structure of the elastic yarn of the tape main body portion includes a warp in-laid yarn laid along the chain stitch structure. In the present invention, the knitting structure having proper elasticity in a longitudinal direction and comprising the chain stitch structure with stitches of stable shapes and the weft laid in the chain stitches is used as the knitting structure of the tape main body portion. Also, in order to provide high elasticity to the tape main body portion, the warp which is the elastic yarn is laid in the chain stitch structure of the tape main body portion in a zigzag manner in the wale direction.

If the coupling element mounting portion and the tape main body portion are connected by the knitting structure formed of only the inelastic yarn between the coupling element mounting portion and the tape main body portion so as to form the buffer area, the fastener tape as a knitted product largely curves in an arc shape with the coupling element mounting portion being on an outer side. Because this curve can not be corrected by heat set, an operation of sewing the slide fastener as a final product on clothes is complicated, and the slide fastener mounting portion can not be straight in the completed product, and especially in thin clothes, thereby generating various defects in terms of appearance and use.

Preferably, boundary areas between the buffer area, and the coupling element mounting portion and the tape main body portion include warp in-laid structures formed of elastic yarns warp-laid in the knitting structure formed of the inelastic yarns. By disposing the warp knitting structures formed of elastic yarns in the boundary areas between the buffer area, and the coupling element mounting portion and the tape main body portion, the warp in-laid structures are mixed with the knitting structures disposed in the respective boundary areas. Although the boundary areas function as barriers and completely intercept transmission of acts of the coupling element mounting portion and the tape main body portion to each other, the boundary area on a side of the tape main body portion stretch and contracts smoothly responding to stretch and contraction of the tape main body portion.

On the other hand, the elastic yarn in the boundary area on a side of the coupling element mounting portion contracts when knitted, so as to bring the entire coupling element mounting portion adjacent to the boundary area into a contracted state and to substantially straighten the entire tape, without hindering mounting of the coupling element. When the slide fastener is sewn on the elastic cloth, the tape main body portion stretches longitudinally in the sewing as described above, thereby facilitating and stabilizing the sewing operation.

Still preferably, the knitting structure formed of the inelastic yarn of the tape main body portion may further include a tricot knitting structure. If the tricot knitting structure is further compounded into the above chain stitch structure, elasticity in the longitudinal direction is decreased, but a thickness and rigidity of the tape main body portion increase, and the tape is suitable for rigid cloth with low elasticity on which the tape is to be sewn. In other words, by making the knitting structure a proper compound structure, the fastener tape can be suitable for a characteristic of the cloth on which the tape is to be sewn.

Further preferably, the buffer area includes a part of a weft in-laid structure formed of the inelastic yarn of the tape main body portion, so as to prevent the tape main body portion from affecting the coupling element mounting portion. And still preferably, the buffer area further includes a tricot knitting structure formed of an inelastic yarn in addition to the weft in-laid structure. If the buffer area is formed of only the weft in-laid yarn, the buffer area is liable to be damaged due to its simple structure when used for a long time, as compared with the other areas. In order to eliminate this problem, the weft in-laid yarn is supported by the tricot knitting structure, thereby enhancing durability of the buffer area. If the chain stitch structure is used instead of the tricot, longitudinal elasticity is excessively suppressed due to the knitting structure, and it may be probable that the buffer area can not function as it should.

DESCRIPTION OF THE PREFERRED EMBODIMENTS

Figure 1:
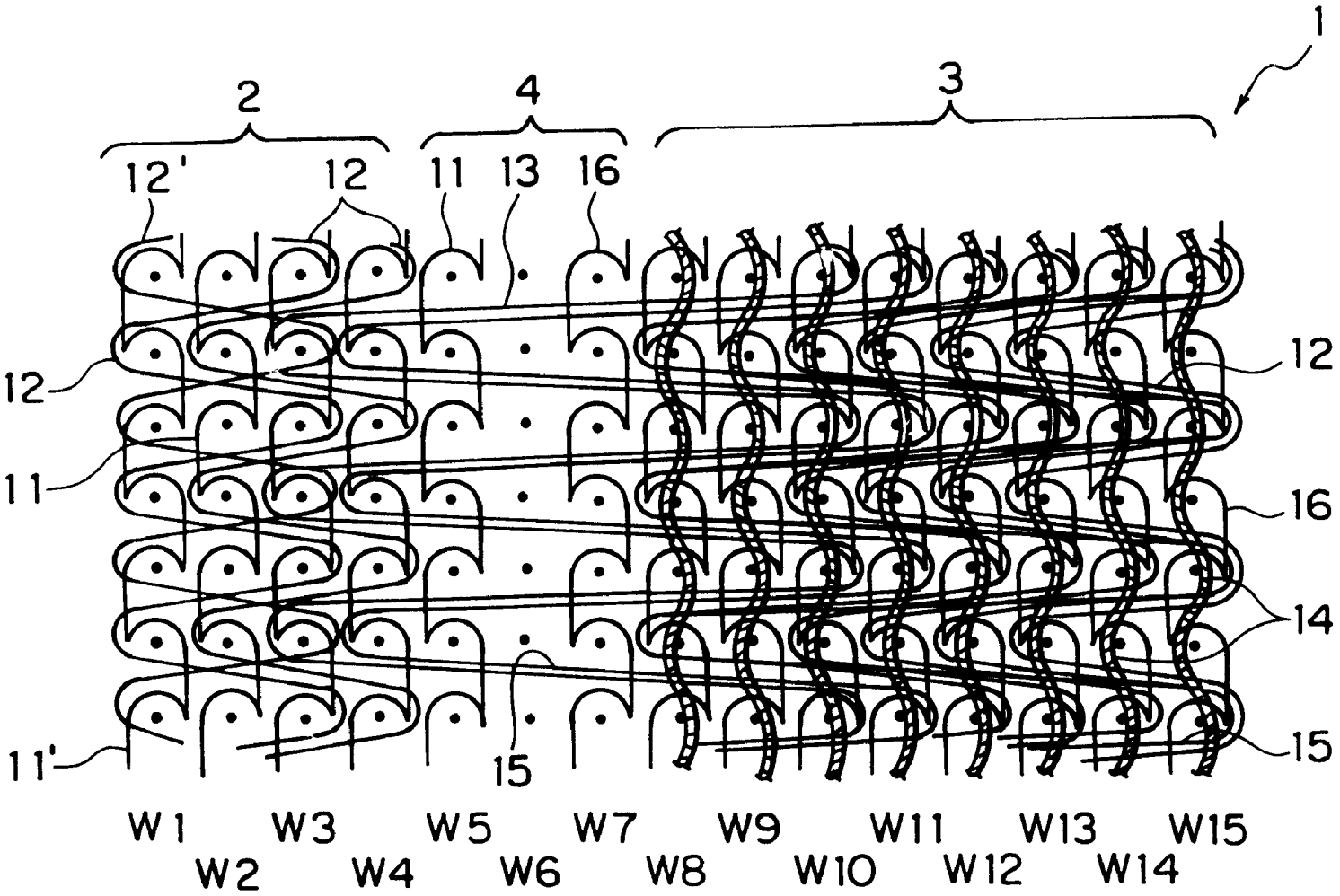
FIG. 1 shows a knitting structure of a first embodiment of a warp-knit tape according to the present invention.

Preferred embodiments of the present invention will be specifically described below based on examples shown in the drawings. The specific examples shown in the drawings are typical knitting structures of the invention, and it is to be understood that the present invention is not limited to these knitting structures. Coupling elements mounted to a warp-knit tape for a slide fastener according to the invention includes independently produced coupling elements made of synthetic resin or metal, in addition to a coil-shaped successive element and a zigzag successive element.

A basic structure of the warp-knit tape 1 of the invention includes, as shown in the drawings, a coupling element mounting portion 2 to which the coupling element (not shown) is mounted, a tape main body portion 3 to be mainly sewn on a main body cloth (not shown) such as clothes, for example, and a buffer area 4 which is a part of a characteristic of the invention between the coupling element mounting portion 2 and the tape main body potion 3. The buffer area 4 is for structurally isolating the coupling element mounting portion 2 and the tape main body portion 3 from each other such that the coupling element mounting portion 2 and the tape main body portion 3 can move independently of each other without affecting each other.

Figure 2:
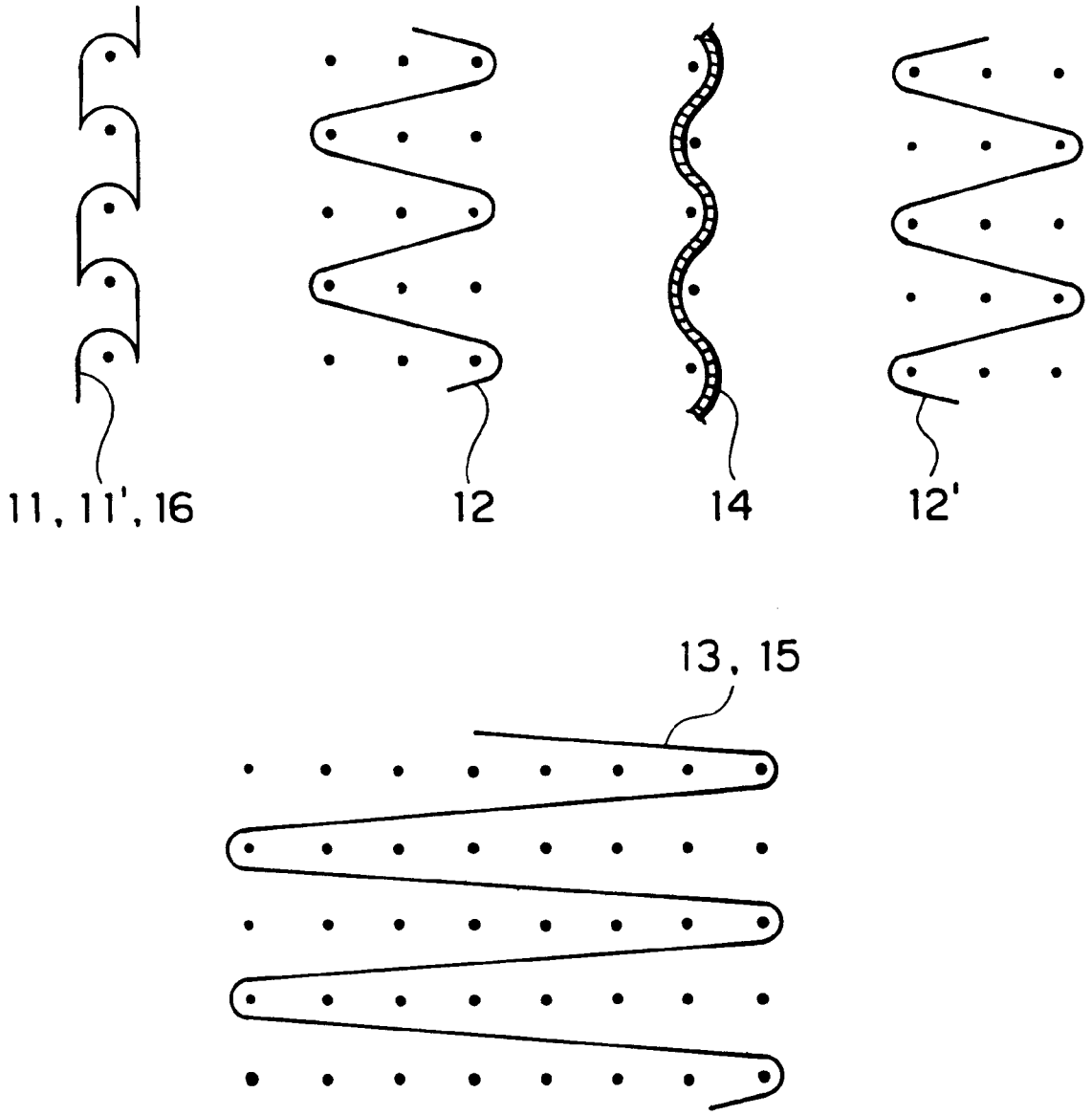
FIG. 2 shows knitting structures of each unit of the knitting structure.

FIG. 1 shows a first embodiment of a knitting structure of a warp-knit tape for a slide fastener of the present invention. FIG. 2 shows a structure of each unit constituting the knitting structure of the tape. According to this embodiment, as shown in FIGS. 1 and 2, in the element mounting portion 2, a knitting structure wherein each wale appears in a longitudinal direction is formed by mixing four chain stitch structures (1-0/0-1) knitted by using chain stitch yarns 11 and 11' through wales W1 to W4, three weft in-laid structures (0-0/3-3, 3-3/0-0) wherein weft in-laid yarns 12 and 12' are laid in every course of the wales W1 to W4 in a zigzag manner, and two weft in-laid structures (0-0/8-8) wherein weft in-laid yarns 13 and 15 are laid in wales W3 to W11 in a zigzag manner, and a chain stitch structure at an outmost edge is formed by using a thick reinforcing chain stitch yarn 11'. The chain stitch yarns 11 and 11' used for the above respective knitting structures are inelastic yarns. As the inelastic yarn used for the respective chain stitch structures, there a re spun yarn, monofilament, multifilament, normal twine, and the like. These yarns are used properly according to a characteristic of cloth on which the tape is to be sewn. The respective weft in-laid yarns 12, 12', 13, and 15 in this embodiment are multifilaments made of polyester.

A basic knitting structure of the tape main body portion 3 comprises chain stitch structures (1-0/0-1) formed of chain stitch yarns 16 and warp in-laid structures (0-0/1-1) formed by laying warp in-laid yarns 14 in a zigzag manner in a wale direction of the chain stitch structures. In the present embodiment, a weft in-laid structure (0-0/8-8) of the weft in-laid yarn 15 is laid and intermingled successively and repeatedly in a zigzag manner in the eight wales W8 to W15 formed of the chain stitch structures and a part of two weft in-laid structures (0-0/8-8) of the weft in-laid yarns 15 laid from the coupling element mounting portion 2 and the buffer area 4 is laid and intermingled successively and repeatedly in a zigzag manner in the four wales W8 to W11. Furthermore, four weft in-laid structures (0-0/3-3) of weft in-laid yarns 12 are laid and intermingled successively and repeatedly in a zigzag manner in six wales W10 to W15 near an outside edge of the tape main body portion 3.

On the other hand, the knitting yarns used for these knitting structures except for tile warp in-laid yarns 14 have the same quality as the yarns used for the coupling element mounting portion 2. In the present embodiment, a thickness of the chain stitch yarns 16 used for the chain stitch structures of the tape main body portion 3 is set at a larger value than that of the chain stitch yarns 11 used for the coupling element mounting portion 2. In other words, a relationship between the yarns in terms of the thickness is the chain stitch yarns 16 of the tape main body portion 3> the chain stitch yarn 11' of the outmost edge of the coupling element mounting portion 2> the chain stitch yarns 11 of the coupling element mounting portion 2.

By especially making the chain stitch yarns 16 of the tape main body portion 3 thick as described above, a proper degree of hardness can be applied to the wales of the chain stitch structures of the chain stitch yarns 16, thereby suppressing waving due to contraction of elastic yarns warp-laid in the wales, and constantly maintaining a flat shape of the tape main body portion 3. By making the chain stitch yarn 11' of the outmost edge of the coupling element mounting portion 2, the outmost edge portion is reinforced, thereby facilitating mounting of the coupling elements.

For the warp in-laid yarns 14, elastic yarns such as spandex yarn, rubber yarn, or covered yarn of the spandex yarn or rubber yarn are used.

The buffer area 4 corresponds to three wales W5 to W7 in FIG. 1. Left and right two wales W5 and W7 of the area 4 are formed of chain stitch structures (1-0/0-1) of the chain stitch yarns 16, and the chain stitch structures are formed by only weft-laying the weft in-laid yarns 13 and 15 respectively laid and intermingled with the tape main body portion 3 and the coupling element mounting portion 2 in a zigzag manner. A wale 6 between the two wales W5 and W7 lacks a warp knitting structure, and only the weft in-laid yarns 13 and 15 are laid through every course in the wale W6. In this embodiment, the chain stitch yarns used for these wales W5 and W7 are the same inelastic yarns as the chain stitch yarns 11 and 16 respectively used for the coupling element mounting portion 2 and the tape main body portion 3.

Because the warp-knit tape 1 for the slide fastener according to the present embodiment has the above structure, the buffer area 4 defined between the inelastic coupling element mounting portion 2 and the highly elastic tape main body 3 having the above-described knitting structures intercepts intense stretching and contracting movements of the highly elastic tape main body 3 before the movements are transmitted to the inelastic coupling element mounting portion 2, thereby enabling the coupling element mounting portion 2 to acts independently without being affected by the tape main body portion 3. In other words, in spite of various stretching and contracting movements of the tape main body portion 3, the chain split is not generated, and a strained phenomenon peculiar to the coupling element mounting portion is not generated, thereby making the tape extremely excellent in terms of an appearance and a touch.

Thus, because high elasticity can be provided to the tape main body portion 3, when the slide fastener using the warp-knit tape 1 of the embodiment is sewn onto thin and highly elastic clothes, the tape 1 and cloth can be sewn together while moving together smoothly. Therefore, it is possible to reliably prevent waving along a sewing line generated due to deviation of the highly elastic cloth and the inelastic cloth from each other at the time of sewing, i.e., a puckering phenomenon wherein the tape 1 and the cloth are sewn together in a state where the tape 1 and the cloth are deviating from each other.

The inelastic yarns only are used for the coupling element mounting portion 2. The knitting structure of the coupling element mounting portion 2 comprises a combination of a plurality of structures commonly used for suppressing elasticity such as a chain stitch structure, a tricot knitting structure, and a warp in-laid structure, for example, and is formed by laying weft in-laid yarns through the respective structures. On the other hand, in the knitting structure of the elastic tape main body portion 3, both the knitting structure and the forming yarns are provided with elasticity. The tape main body portion 3 employs the knitting structure wherein elastic yarns are used as a part of the constituent yarns and are interlaced with the inelastic yarns, so that the knitting structure employed realizes the most stable knitting state and required elasticity. Because the buffer area 4 is formed by using the weft in-laid yarns only, influence of acts of the tape main body portion 3 on the coupling element mounting portion 2 can be completely intercepted by the buffer area 4.

Figure 3:
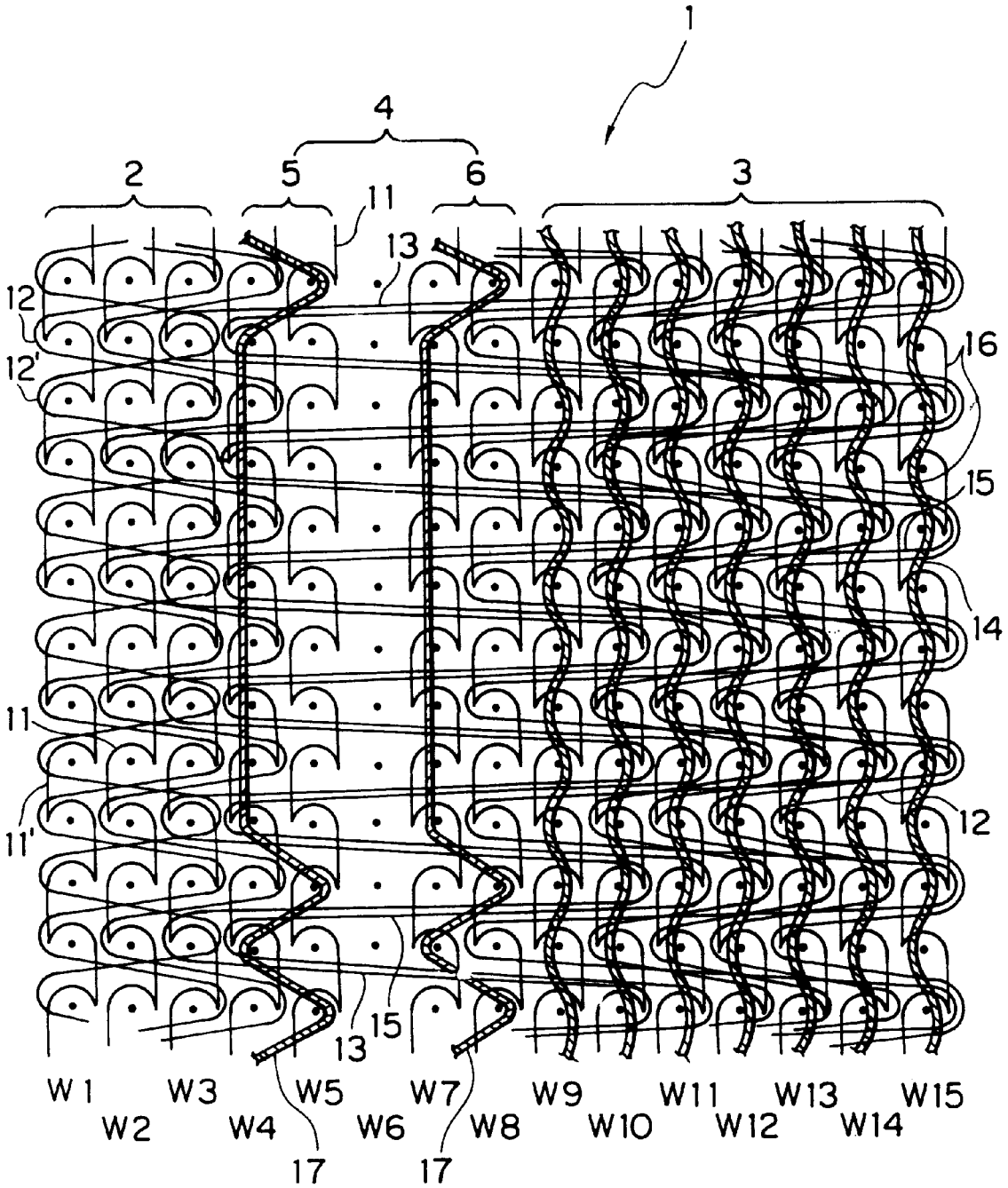
FIG. 3 shows a knitting structure of a second embodiment of a warp-knit tape of the invention.
Figure 4:
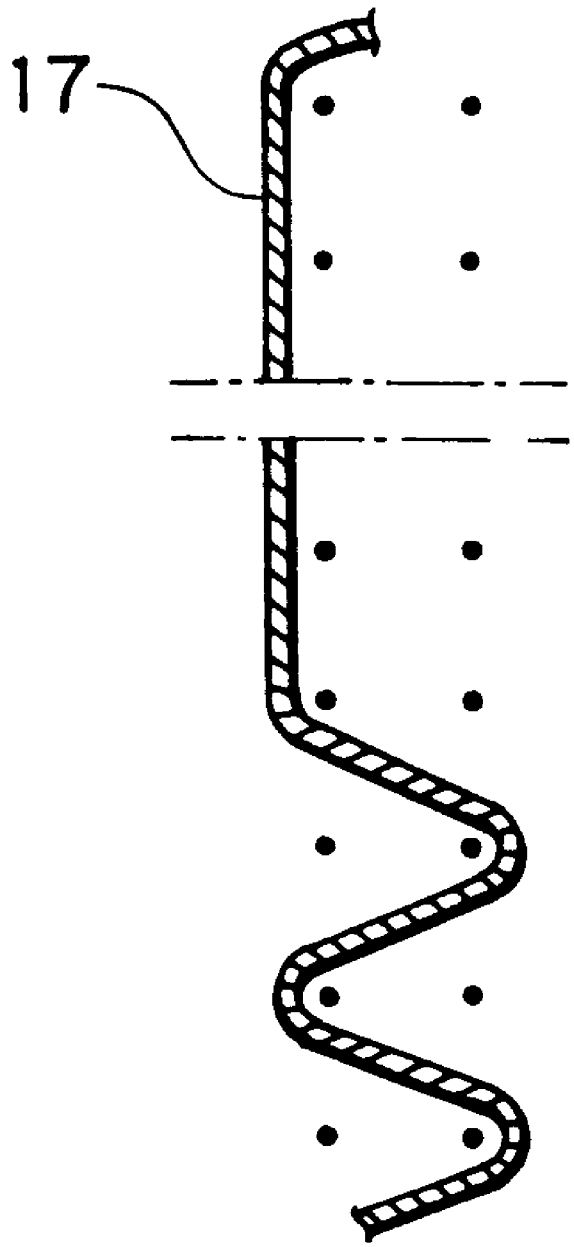
FIG. 4 is a unit knitting structure of a warp in-laid yarn which is an elastic yarn and is warp laid in boundary areas of the warp-knit tape with a midway portion omitted.

FIGS. 3 and 4 show a second embodiment of the present invention. The second embodiment is different from the above first embodiment in that two wales W4 and W5 are formed by warp-laying a warp in-laid yarn 17 which is an elastic yarn in a chain stitch structure knitted on a side of the coupling element mounting portion 2 nearest to the tape main body and a chain stitch structure of the buffer area 4 on a side of the coupling element mounting portion 2, and that two wales W7 and W8 are formed by warp-laying the warp in-laid yarn 17 which is the elastic yarn in a chain stitch structure knitted on a side of the tape main body portion 3 nearest to the coupling element mounting portion 2 and a chain stitch structure of the buffer area 4 on a side of the tape main body portion 3. The above left and right pairs of wales W4, W5, and W7, W8 form boundary areas 5 and 6 between the coupling element mounting portion 2, the tape main body portion 3, and the buffer area 4 of the invention. The boundary portions 5 and 6 are portions of the buffer area 4 in the present specification, but the boundary areas 5 and 6 may be completely separated from the buffer area 4.

According to the present embodiment, as shown in FIG. 4, the warp in-laid structures of the warp in-laid yarns 17 which are elastic yarns are formed by repeating a unit structure of 0-0/2-2/0-0/2-2/2-2/2-2/2-2/2-2/2-2/2-2/2-2/2-2/2-2. In other words, the warp in-laid yarn 17 is linearly laid through nine courses of chain stitches of the wale W4 out of the adjacent two wales W4 and W5 along the wale W4, distributed to the adjacent wale W5 at a tenth course, intermingles through two courses in a zigzag manner, and these steps are repeated. The wales W7 and W8 forming the boundary area 6 on the side of the tape main body portion 3 are formed of the same knitting structure as the boundary area 5 on the side of the coupling element mounting portion 2.

By warp-laying the warp in-laid yarns 17 which are the elastic yarns in the respective boundary areas 5 and 6, weft in-laid yarns 13 and 15 horizontally running in the respective boundary areas 5, 6 are mixed with the warp in-laid structures. Because the respective boundary areas 5, 6 function as barriers, transmission of acts of both the coupling element mounting portion 2 and the tape main body portion 3 to each other is further completely intercepted via the buffer area 4. In the buffer area 4, if the boundary area 6 on the side of the tape main body portion 3 does not stretch and contract at all in a longitudinal direction following the stretch and contraction of the tape main body portion 3, the buffer area 4 hinders the stretch and contraction of the tape main body portion 3 on the contrary. However, because the buffer area 4 is formed by using the weft in-laid yarns having longitudinal elasticity as described above, both the areas 5 and 6 follow the stretch and contraction of the tape main body portion 3 to some extent together with the warp in-laid yarns 17 which are the elastic yarns.

Because the warp in-laid yarn 17 which is the elastic yarn disposed in the boundary area 5 on the side of the coupling element mounting portion 2 contracts when knitted, the contracting force of the warp in-aid yarn 17 brings the entire adjacent coupling element mounting portion 2 into a contracting state, such that the entire tape is substantially straightened. Thus, there is no-hindrance to mounting of the coupling elements. When the slide fastener is sewn onto the elastic cloth, because the tape main body portion 3 stretches in the longitudinal direction at the time of sewing as described above, the sewing operation is carried out smoothly and stably.

Figure 5:
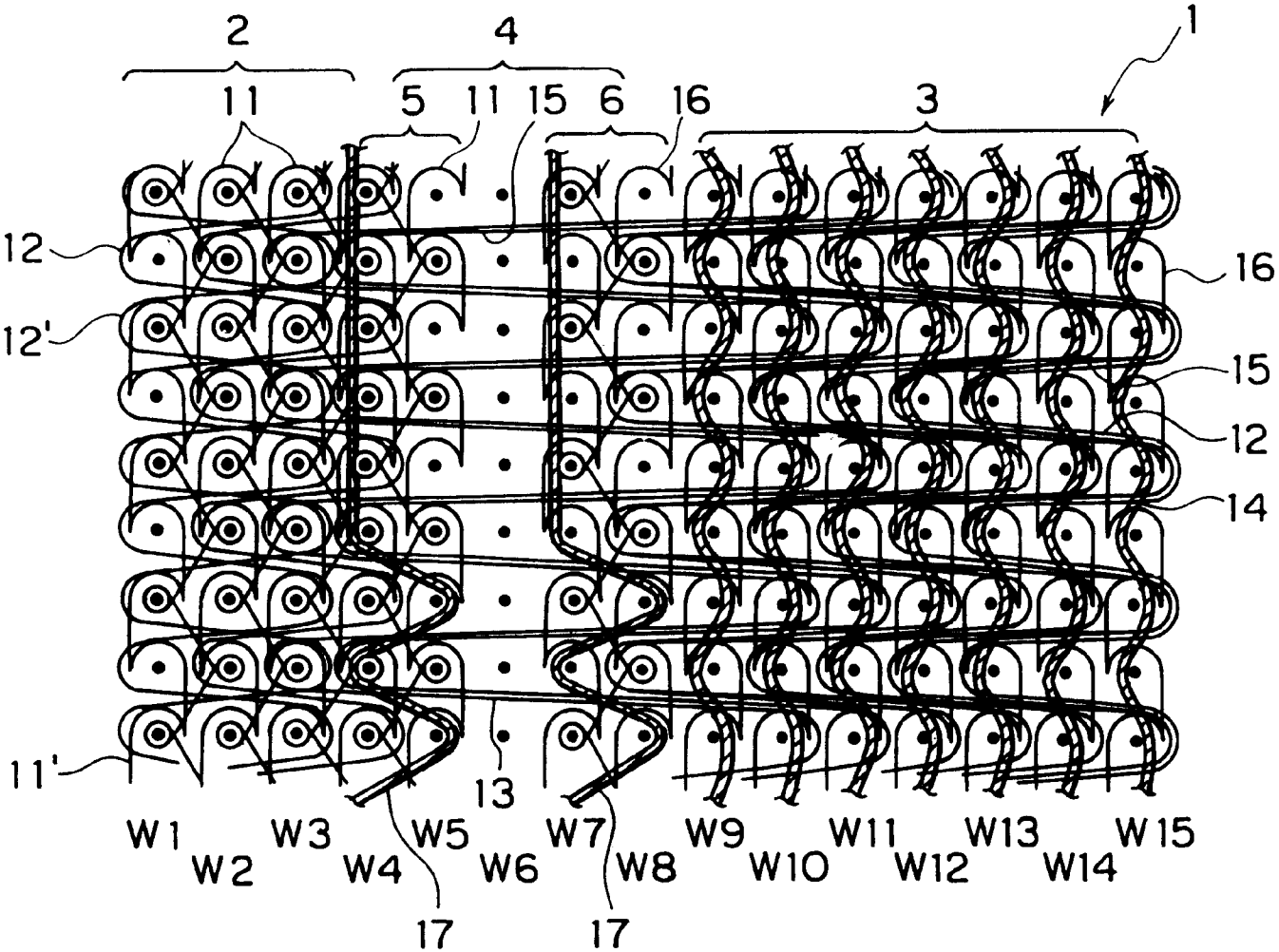
FIG. 5 shows a knitting structure of a third embodiment of a warp-knit tape of the invention.

FIG. 5 shows a third embodiment of the present invention which is different from the above second embodiment in that tricot knitting structures are further mixed with the chain stitch structures in the coupling element mounting portion 2 and the chain stitch structures in the boundary areas 5 and 6. By mixing the tricot knitting structures in this manner, a knitting state of the coupling element mounting portion 2 is stabilized, and elasticity of the boundary areas 5 and 6 is reduced to stabilize knitting states of the areas 5 and 6. With this structure, influences of the acts of the coupling element mounting portion 2 and the tape main body portion 3 on each other can be further reduced.

Figure 6:
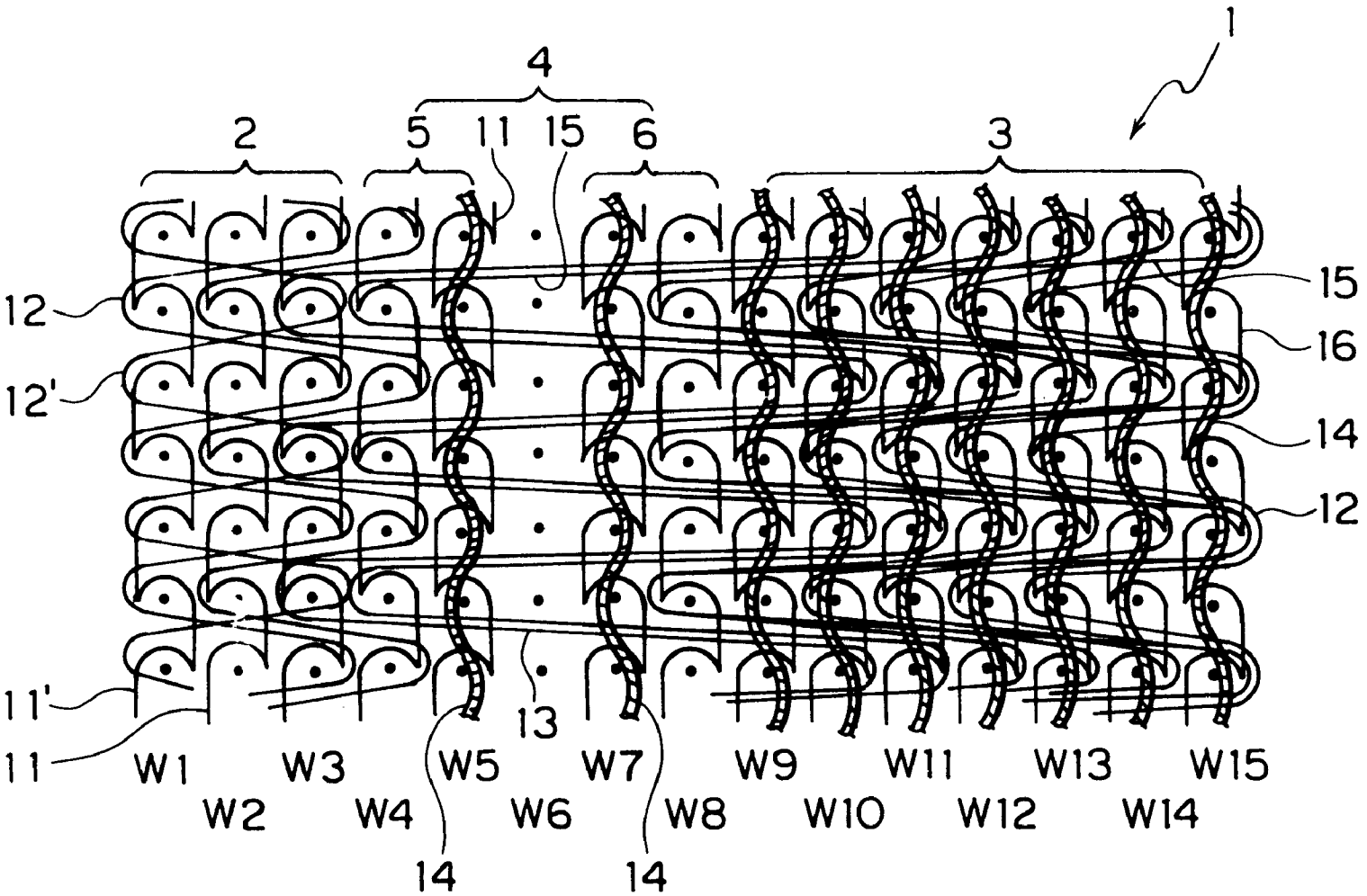
FIG. 6 shows a knitting structure of a fourth embodiment of a warp-knit tape of the invention.

FIG. 6 shows a fourth embodiment of the present invention which is different from the above second embodiment shown in FIG. 3 in that the warp in-laid yarns 14 which are elastic yarns are warp-laid in a zigzag manner in the chain stitch structures forming the wales W5 and W7 of the two pairs of wales W4, W5; W7, W8 of the boundary areas 5 and 6, instead of the warp in-laid yarns 17 warp laid in the boundary areas 5 and 6. The warp in-laid structures of and yarns used for the wales W5 and W7 are the same as those of the tape main body portion 3. In the present embodiment, elasticity of the boundary areas 5 and 6 in the above second embodiment approximates that of the tape body. In addition to operations and effects of the above second embodiment, the coupling element mounting portion 2, the tape main body portion 3, and the respective boundary portions 5 and 6 well fit each other in the present embodiment, thereby further decreasing disharmony in terms of appearance and touch.

Figure 7:
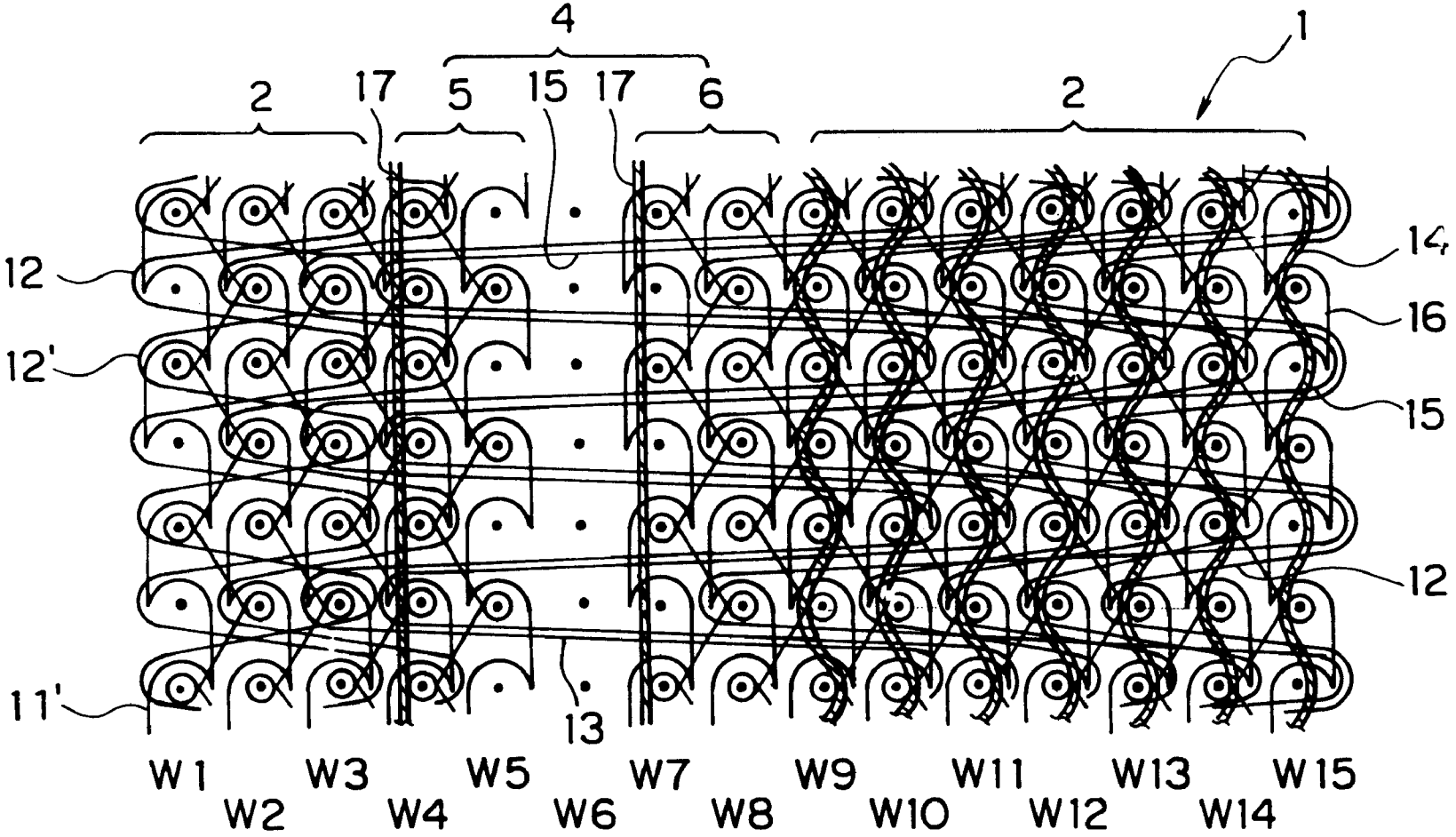
FIG. 7 shows a knitting structure of a fifth embodiment of a warp-knit tape of the invention.

FIG. 7 shows a fifth embodiment of the invention, wherein tricot knitting structures are mixed with the chain stitch structures of the coupling element mounting portion 2, the tape main body portion 3, and the boundary areas 5, 6. Furthermore, the warp in-laid yarns 17 which are elastic yarns are linearly laid in the wales W4 and W7 of the above fourth embodiment formed of the chain stitch structures of the boundary areas 5 and 6 without being intermingled with each stitch of the wales W4 and W7. Therefore, in this embodiment, the entire warp-knit tape 1 is formed to be thick, and is provided with rigidity, and the buffer area 4 is allowed to freely stretch and contract in a range wherein the buffer area 4 is caused to stretch and contract by the knitting structures of the coupling element mounting portion 2 and the tape main body portion 3. In this manner, the thickness of the entire warp-knit tape 1 is determined not only by selecting a kind and a thickness of the knitting yarns, but also by selecting the kind and a number of the knitting structures to be mixed.

Figure 8:
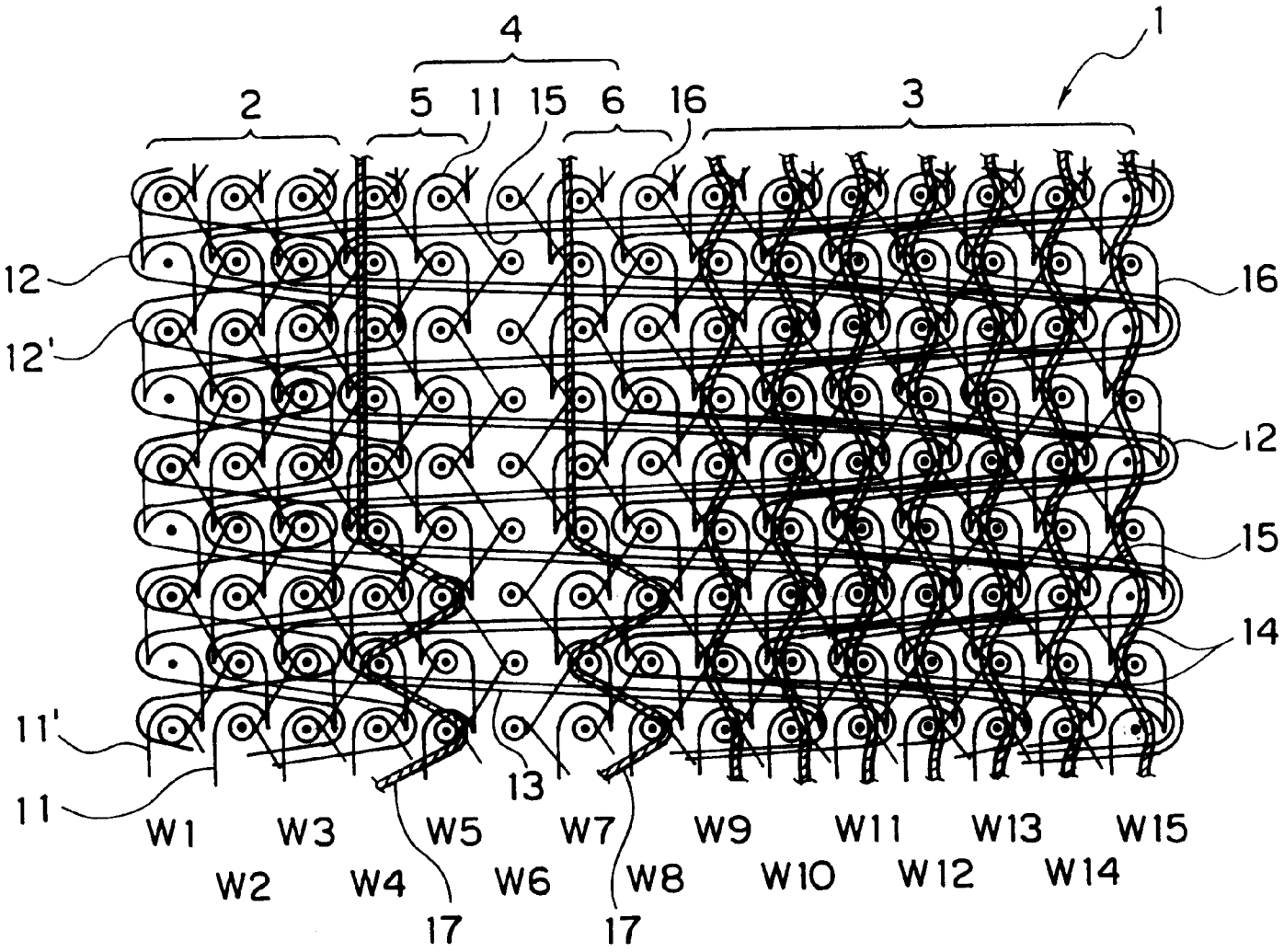
FIG. 8 shows a knitting structure of a sixth embodiment of a warp-knit tape of the invention.

FIG. 8 shows a sixth embodiment which is different from the above fifth embodiment in that the warp in-laid structure (0-0/2-2/0-0/2-2/2-2/2-2/2-2/2-2/2-2/2-2/2-2/2-2) of the above second embodiment is employed as the warp in-laid structure, and the tricot knitting structures are added to the entire buffer area 4 of the fifth embodiment. Therefore, in this embodiment, the tricot knitting structure is also knitted into the wale W6 which comprises only the weft in-laid yarns 13 and 15 of the buffer area 4. By forming stitches in the wale W6 comprising only the weft in-laid yarns 13 and 15 of the buffer area 4 as described above, elasticity in a longitudinal direction of the buffer area 4 is suppressed, thereby stabilizing the shape of the buffer area 4. The reason of employing the tricot knitting structure in this embodiment is that the tricot knitting structure is superior to the chain stitch structure in elasticity in a warp direction.

The above first to sixth embodiments only show representative examples of the structure of the present invention as mentioned above, and the knitting structure is not limited to that in the above embodiments, but various modifications are possible, and the structure and quality of the knitting yarn to be used can be freely selected according to usage. Also, the number of the wales in a width direction of the tape 1 can be increased or decreased according to a size of the slide fastener.

Figure 9:
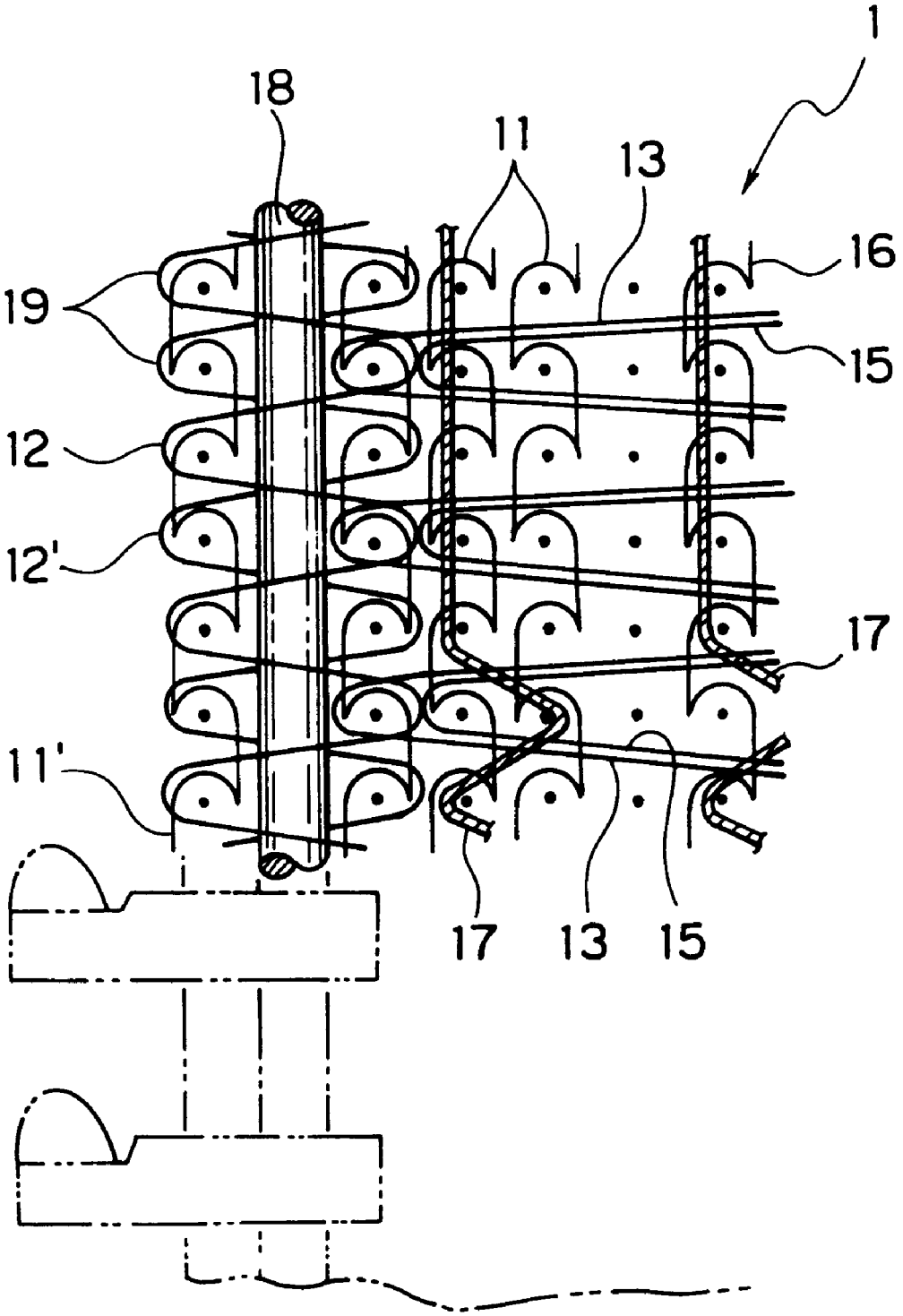
FIG. 9 is fragmentary a plan view of a schematic structure of a warp-knit tape of the invention suitable for use wherein discrete coupling elements are mounted to the tape.

Further, the warp-knit tape 1 on which the successive coupling elements are mounted by sewing is described in the above description. If the warp-knit tape 1 is a fastener tape on which independent molded coupling elements made of synthetic resin or metal, for example, are individually mounted by injection or clamping, a core string 18 to be used for mounting the coupling elements is inserted between two chain stitch structures of the Coupling element mounting portion 2 in a warp direction and is knitted by two weft in-laid yarns 19, 19, as shown in FIG. 9.

Figure 10A:
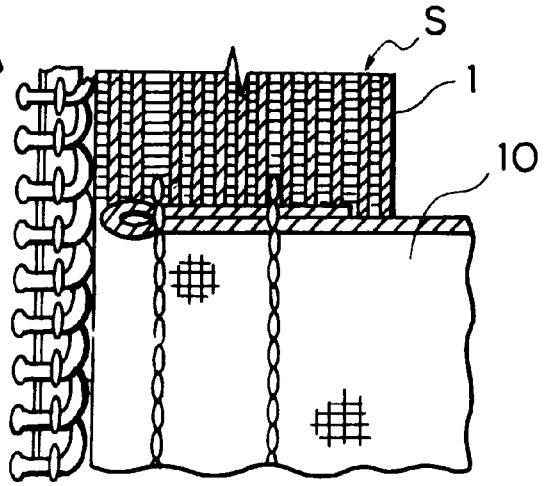
FIGS. 10(A) to 10(C) are fragmentary plan views of an example of a sewing position of a fastener chain employing a warp-knit tape of the invention to elastic cloth.
Figure 10B:
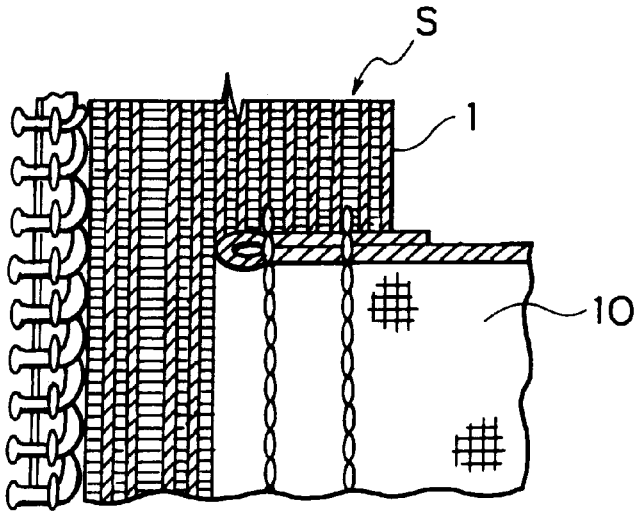
Figure 10C:
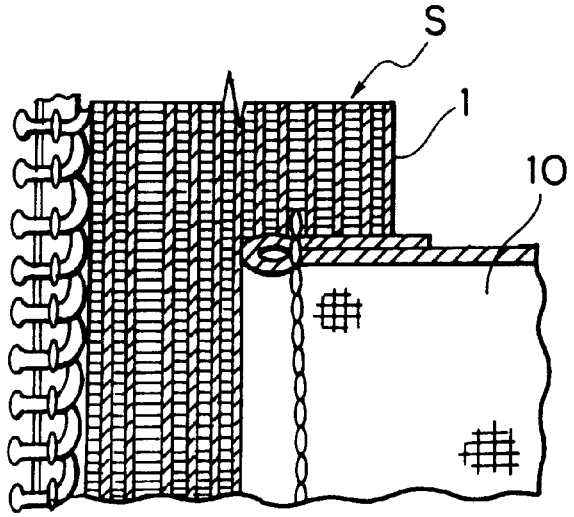
Figure 11A:
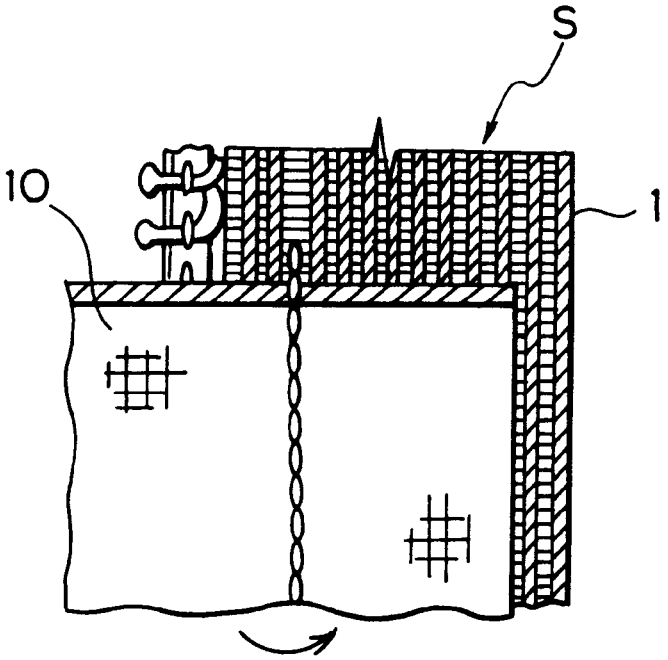
FIGS. 11(A) and 11(B) are fragmentary plan views of another example of the sewing position of the fastener chain employing the warp-knit tape of the invention to elastic cloth.
Figure 11B:
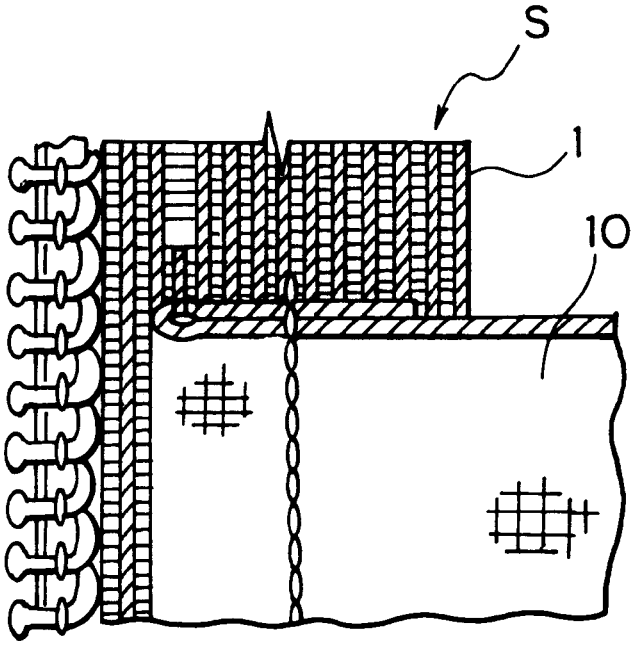

FIGS. 10(A) to 10(C) show examples of sewing position where a fastener stringer S employing the warp knitting tape 1 having the above-described knitting structure is sewn on a cloth 10 having high elasticity. In FIGS. 10(A) to 10(C), a sewing edge portion of the cloth 10 is folded in two and the folded edge portion is sewn from above. FIGS. 10(A) and 10(B) show an example of a double sewing, and FIG. 10(C) shows an example of a single sewing. In examples shown in FIGS. 10(B) and 10(C) out of these examples, a sewing line is positioned in the tape main body portion 3. FIGS. 11(A) and 11(B) show another example of sewing of the fastener stringer S employing the warp-knit tape 1 on the highly elastic cloth 10. As shown in FIG. 11(A), after sewing the sewing edge portion of the cloth 10 along the buffer area 4 of the warp knitting tape 1, the cloth 10 is folded back along the sewing line. Then, as shown in FIG. 11(E), the sewing edge portion and the cloth 10 are simultaneously sewn on the tape main body portion 3 of the warp-knit tape 1. Because the buffer area 4 serves as the smallest sewing line in the sewing shown in FIGS. 11(A) and 11(B), the sewing can be stably carried if the buffer area 4 is used as a standard for sewing.

What is claimed is:

1. A warp-knit tape for a slide fastener comprising:

(a) a coupling element mounting portion, (b) a tape main body portion, and (c) a buffer area between the mounting portion and the tape main body portion, wherein the coupling element mounting portion has an inelastic knitting structure in a longitudinal direction, the tape main body portion has an elastic knitting structure in a longitudinal direction, and the buffer area has a different knitting structure than the mounting portion and the tape main body portion, the buffer area preventing longitudinal stretching forces acting on the tape main body portion from adversely acting on the mounting portion.

2. A warp-knit tape according to claim 1, wherein the knitting structure of the coupling element mounting portion includes a plurality of knitting structures using an inelastic yarn, the tape main body portion includes at least mixed structures of an inelastic yarn and an elastic yarn, and the buffer area includes at least a part of the knitting structure of the inelastic yarn of the tape main body portion in common with the tape main body portion.

3. A warp-knit tape according to claim 2, wherein the knitting structure of the inelastic, yarn of the tape main body portion includes at least a weft in-laid structure and a chain stitch structure, and the knitting structure of the elastic yarn of the tape main body portion includes a warp in-laid yarn laid along said chain stitch structure.

4. A warp-knit tape according to claim 2, further comprising boundary areas between the buffer area, and the coupling element mounting portion and the tape main body portion, the boundary areas having warp in-laid structures formed of elastic yarns warp-laid in the knitting structure formed of the inelastic yarns.

5. A warp-knit tape according to claim 3, wherein the knitting structure formed of the inelastic yarn of the tape main body portion further includes a tricot knitting structure.

6. A warp-knit tape according to claim 2, wherein the buffer area includes a part of a weft in-laid structure formed of the inelastic yarn of the tape main body portion.

7. A warp-knit tape according to claim 6, wherein said buffer area further includes a tricot knitting structure formed of an inelastic yarn.

8. A warp-knit tape for a slide fastener comprising:

(a) a coupling element mounting portion and (b) a tape main body portion, wherein the coupling element mounting portion has an inelastic knitting structure in a longitudinal direction, the tape main body portion has an inelastic knitting structure in a longitudinal direction, and a buffer area which has a different knitting structure than the mounting portion and the tape main body portion, the buffer area preventing longitudinal stretching forces acting on the tape main body portion from adversely acting on the mounting portion, wherein the knitting structure of the coupling element mounting portion includes a plurality of knitting structures using an inelastic yarn, the tape main body portion includes at least mixed structures of an inelastic yarn and an elastic yarn, and the buffer area includes at least a part of the knitting structure of the inelastic yarn of the tape main body portion in common with the tape main body portion, wherein the knitting structure of the inelastic yarn of the tape main body portion includes at least a weft in-laid structure and a chain stitch structure, and the knitting structure of the elastic yarn of the tape main body portion includes a warp in-laid yarn laid along said chain stitch structure.

9. A warp-knit tape according to claim 8, wherein the knitting structure formed of the inelastic yarn of the tape main body portion further includes a tricot knitting structure.

* * * * *